US011170708B2

(12) United States Patent
Yu et al.

(10) Patent No.: US 11,170,708 B2
(45) Date of Patent: Nov. 9, 2021

(54) GAMMA CORRECTION METHOD AND DEVICE, DISPLAY DEVICE, AND COMPUTER STORAGE MEDIUM

(71) Applicants: Chengdu BOE Optoelectronics Technology Co., Ltd., Sichuan (CN); BOE Technology Group Co., Ltd., Beijing (CN)

(72) Inventors: Yong Yu, Beijing (CN); Chuanyan Lan, Beijing (CN); Xin Wang, Beijing (CN)

(73) Assignee: CHENGDU BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 16/650,513

(22) PCT Filed: Jul. 9, 2019

(86) PCT No.: PCT/CN2019/095302
§ 371 (c)(1),
(2) Date: Mar. 25, 2020

(87) PCT Pub. No.: WO2020/011169
PCT Pub. Date: Jan. 16, 2020

(65) Prior Publication Data

US 2020/0286423 A1 Sep. 10, 2020

(30) Foreign Application Priority Data

Jul. 12, 2018 (CN) ..... 201810764429.6

(51) Int. Cl.
*G09G 3/3208* (2016.01)

(52) U.S. Cl.
CPC ... *G09G 3/3208* (2013.01); *G09G 2320/0673* (2013.01); *G09G 2360/145* (2013.01)

(58) Field of Classification Search
CPC ..... G09G 3/32; G09G 3/3208; G09G 3/3233–325; G09G 3/3275–3291;
(Continued)

(56) References Cited

U.S. PATENT DOCUMENTS 6,690,383 B1 * 2/2004 Braudaway ..... G09G 5/006 345/600
9,478,163 B2 10/2016 Lee et al.
(Continued)

FOREIGN PATENT DOCUMENTS

CN 105259687 A 1/2016
CN 105741775 A 7/2016
(Continued)

OTHER PUBLICATIONS

International search report of PCT application No. PCT/CN2019/095302 dated Sep. 26, 2019.
(Continued)

*Primary Examiner* — Nathan Danielsen
(74) *Attorney, Agent, or Firm* — Fay Sharpe LLP

(57) ABSTRACT

The present disclosure provides a gamma correcting method and device, a display device, and a computer storage medium, which belong to the field of display technologies. The method includes: acquiring measurement data of a first display panel, wherein the measurement data includes m display brightness levels to be compensated and m sets of compensation parameters corresponding to the m display brightness levels, where m is a positive integer; and compensating a second display panel at a corresponding display brightness level with the m sets of compensation parameters respectively, wherein the second display panel and the first display panel have same structure and material.

20 Claims, 6 Drawing Sheets

(58) Field of Classification Search
CPC .... G09G 2320/0223; G09G 2320/0233–0242; G09G 2320/0271; G09G 2320/0276; G09G 2320/0285–0295; G09G 2320/062–0653; G09G 2320/0666; G09G 2320/0673; G09G 2320/0686; G09G 2320/0693; G09G 2360/14; G09G 2360/145–148
See application file for complete search history.

(56) References Cited

U.S. PATENT DOCUMENTS

| | | | | |
|---|---|---|---|---|
| 2008/0074372 | A1* | 3/2008 | Baba | G09G 3/3406 345/89 |
| 2012/0062609 | A1 | 3/2012 | Dae-Sick | |
| 2016/0343340 | A1 | 11/2016 | Zheng et al. | |
| 2017/0011689 | A1* | 1/2017 | Huang | G09G 3/3406 |
| 2017/0309213 | A1* | 10/2017 | Roh | G09G 3/2003 |
| 2019/0051235 | A1 | 2/2019 | Zhang et al. | |

FOREIGN PATENT DOCUMENTS

| | | | |
|---|---|---|---|
| CN | 106128383 | A | 11/2016 |
| CN | 106782303 | A | 5/2017 |
| CN | 106782307 | A | 5/2017 |
| CN | 107195270 | A | 9/2017 |
| CN | 107274833 | A | 10/2017 |
| CN | 107578760 | A | 1/2018 |
| CN | 108550345 | A | 9/2018 |
| WO | WO2015000270 | A1 | 1/2015 |

OTHER PUBLICATIONS

First office action of Chinese application No. 201810764429.6 dated Jul. 22, 2019.

* cited by examiner

GAMMA CORRECTION METHOD AND DEVICE, DISPLAY DEVICE, AND COMPUTER STORAGE MEDIUM

This application is a 371 of PCT Patent Application No. PCT/CN2019/095302, filed Jul. 9, 2019, which claims priority to Chinese Patent Application No. 201810764429.6, filed Jul. 12, 2018 and entitled "Gamma correction method and device, display device and computer storage medium", the entire contents of which are incorporated herein by reference.

TECHNICAL FIELD

The present disclosure relates to the field of display technology, and in particular, to a gamma correction method, a gamma correction device, a display device, and a computer storage medium.

BACKGROUND

As the display technology develops, an organic light-emitting diode (OLED), as a current-type light-emitting device, is increasingly used in the field of high-performance displays due to its self-luminous characteristic, fast response, and wide viewing angle, etc. Since the OLED display panel has self-luminous characteristics, after a plurality of OLED display panels is prepared in a production process, it is necessary to perform gamma correction on each of the OLED display panels at a plurality of display brightness levels respectively to ensure the optical effect of each of the OLED display panels at each display brightness level. Gamma correction refers to adjustment of the display panel, so that gamma values of the adjusted display panel at the corresponding display brightness levels are within a standard gamma value range.

SUMMARY

The present disclosure provides a gamma correcting method, a gamma correction device, a display device and a computer storage medium. The technical solutions are as follows:

In an aspect, a gamma correcting method is provided. The method comprises: acquiring measurement data of a first display panel, wherein the measurement data comprises m display brightness levels to be compensated and m sets of compensation parameters corresponding to the m display brightness levels, where m is a positive integer; and compensating a second display panel at a corresponding display brightness level with the m sets of compensation parameters respectively; wherein the second display panel and the first display panel have same structure and material.

Optionally, acquiring the measurement data of the first display panel comprises: acquiring grayscale brightness values of all grayscale binding points of the first display panel at a first display brightness level, wherein the first display brightness level is any display brightness level in the m display brightness levels; determining all target grayscale binding points from all the grayscale binding points, wherein a difference between an actual grayscale brightness value of the target grayscale binding point and a corresponding standard grayscale brightness value is greater than a difference threshold; and generating a compensation parameter corresponding to the first display brightness level according to grayscales of all the target grayscale binding points and the corresponding standard grayscale brightness values.

Optionally, generating the compensation parameter corresponding to the first display brightness level according to the grayscales of all the target grayscale binding points and the corresponding standard grayscale brightness values comprises: acquiring any two target grayscale binding points of all the target grayscale binding points; determining a compensation magnification and a compensation amount using the grayscales of the any two target grayscale binding points and the corresponding standard grayscale brightness values, according to a correction formula: $Z=X*G+offset$, where X denotes the compensation magnification, offset denotes the compensation amount, G denotes the grayscale of the target grayscale binding point, and Z denotes the standard grayscale brightness value corresponding to the target grayscale binding point; and determining the compensation magnification and the compensation amount as the compensation parameters corresponding to the first display brightness level when a difference between a target grayscale brightness value of each of the target grayscale binding points that have been compensated with the compensation magnification and the compensation amount and the corresponding standard grayscale brightness value is not greater than the difference threshold.

Optionally, wherein the measurement data further comprises grayscales of all the target grayscale binding points at the first display brightness level, and compensating the second display panel at the corresponding display brightness level with the m sets of compensation parameters respectively comprises: compensating each of the target grayscale binding points of the second display panel at the first display brightness level with the compensation parameter corresponding to the first display brightness level.

Optionally, the compensation parameter comprises a compensation magnification and a compensation amount, and compensating each of the target grayscale binding points of the second display panel at the first display brightness level with the compensation parameter corresponding to the first display brightness level comprises: compensating, based on the grayscale of each of the target grayscale binding points, each of the target grayscale binding points of the second display panel at the first display brightness level according to a compensation formula; wherein the correction formula is $Y=X*G+offset$, where X denotes the compensation magnification, offset denotes the compensation amount, G denotes the grayscale of the target grayscale binding point, and Y denotes the grayscale brightness value of the target grayscale binding point after compensation.

Optionally, acquiring the measurement data of the first display panel comprises: determining the m display brightness levels according to brightness data of the first display panel on which gamma correction at a second display brightness level is completed, wherein the second display brightness level is different from the m display brightness levels; and compensating the second display panel at the corresponding display brightness level with the m sets of compensation parameters respectively comprises: compensating the second display panel at the corresponding display brightness level with the m sets of compensation parameters respectively after gamma correction is performed on the second display panel at the second display brightness level.

Optionally, the second display brightness level is a maximum display brightness level.

Optionally, the brightness data is obtained by measuring the brightness of the first display panel at each display brightness level with an optical detector.

Optionally, the second display panel and the first display panel satisfy one of the following relationships: the second display panel and the first display panel belong to the same production batch; and the second display panel and the first display panel are the same display panel.

In another aspect, a gamma correction device is provided. The device comprises a processor and a memory, wherein the memory is configured to store a computer program; and the processor is configured to execute the computer program stored in the memory; the computer program comprising instructions for implementing following operations: acquiring measurement data of a first display panel, wherein the measurement data comprises m display brightness levels to be compensated and m sets of compensation parameters corresponding to the m display brightness levels, where ill is a positive integer; and compensating a second display panel at a corresponding display brightness level with the in sets of compensation parameters respectively; wherein the second display panel and the first display panel have same structure and material.

Optionally, the computer program further comprises instructions for implementing following operations: acquiring grayscale brightness values of all grayscale binding points of the first display panel at a first display brightness level, wherein the first display brightness level is any display brightness level in the m display brightness levels;

determining all target grayscale binding points from all the grayscale binding points, wherein a difference between an actual grayscale brightness value of the target grayscale binding point and a corresponding standard grayscale brightness value is greater than a difference threshold; and generating a compensation parameter corresponding to the first display brightness level according to grayscales of all the target grayscale binding points and the corresponding standard grayscale brightness values.

Optionally, the computer program further comprises instructions for implementing following operations: acquiring any two target gray scale binding points of all the target grayscale binding points; determining a compensation magnification and a compensation amount using the grayscales of the any two target grayscale binding points and the corresponding standard grayscale brightness values, according to a correction formula: Z=X*G+offset, where X denotes the compensation magnification, offset denotes the compensation amount, G denotes the grayscale of the target grayscale binding point, and Z denotes the standard grayscale brightness value corresponding to the target gray scale binding point; and determining the compensation magnification and the compensation amount as the compensation parameters corresponding to the first display brightness level when a difference between a target grayscale brightness value of each of the target grayscale binding points that have been compensated with the compensation magnification and the compensation amount and the corresponding standard grayscale brightness value is not greater than the difference threshold.

Optionally, the measurement data further comprises grayscales of all the target grayscale binding points at the first display brightness level, and the computer program further comprises instructions for implementing following operations: compensating each of the target grayscale binding points of the second display panel at the first display brightness level with the compensation parameter corresponding to the first display brightness level.

Optionally, the compensation parameter comprises a compensation magnification and a compensation amount, and the computer program further comprises instructions for implementing following operations: compensating, based on the grayscale of each of the target grayscale binding points, each of the target grayscale binding points of the second display panel at the first display brightness level according to a compensation formula; wherein the correction formula is Y==X*G+offset, where X denotes the compensation magnification, offset denotes the compensation amount, G denotes the grayscale of the target grayscale binding point, and Y denotes the grayscale brightness value of the target grayscale binding point after compensation.

Optionally, the computer program further comprises instructions for implementing following operations: determining the in display brightness levels according to brightness data of the first display panel on which gamma correction at a second display brightness level is completed, wherein the second display brightness level is different from the m display brightness levels; and compensating the second display panel at the corresponding display brightness level with the m sets of compensation parameters respectively after gamma correction is performed on the second display panel at the second display brightness level.

Optionally, the second display brightness level is a maximum display brightness level.

Optionally, the brightness data is obtained by measuring the brightness of the first display panel at each display brightness level with an optical detector.

Optionally, the second display panel and the first display panel satisfy one of the following relationships: the second display panel and the first display panel belong to the same production batch; and the second display panel and the first display panel are the same display panel.

In yet another aspect, a display device is provided. The device comprises a gamma correction device, the gamma correction device comprising a processor and a memory, wherein the memory is configured to store a computer program; and the processor is configured to execute the computer program stored in the memory; the computer program comprising instructions for implementing following operations: acquiring measurement data of a first display panel, wherein the measurement data comprises m display brightness levels to be compensated and m sets of compensation parameters corresponding to the m display brightness levels, where m is a positive integer; and compensating a second display panel at a corresponding display brightness level with the m sets of compensation parameters respectively; wherein the second display panel and the first display panel have same structure and material.

In still yet another aspect, a computer storage medium is provided. The computer storage medium comprises instructions stored therein, wherein the instructions, when executed by a process, cause the process to implement the gamma correcting method according to in the first aspect.

DETAILED DESCRIPTION

Embodiments of the present disclosure will be described in further detail with reference to the accompanying drawings, to make the objects, technical solutions, and advantages of the present disclosure clearer.

A currently produced OLED display panel has multiple display brightness levels, and the nit values (brightness intensity) of the display panel is different at different display brightness levels. Grayscales 0-255 exist at each display brightness level. At any display brightness, different grayscale brightness values corresponding to different grayscales are different. For example, the grayscale brightness value corresponding to grayscale 0 is 0, and the grayscale brightness value corresponding to grayscale 255 is the maximum grayscale brightness value at this display brightness level. A corresponding relationship between grayscales and grayscale brightness values at each display brightness level may be denoted by a gamma curve. The gamma curve may intuitively reflect whether gamma values of the display panel under the corresponding display brightness level are within a standard gamma value range. A grayscale binding point on the gamma curve satisfies: $I=Imax\times(G/255)n$, where G denotes the grayscale of the grayscale binding point, I denotes the grayscale brightness value of this grayscale binding point, Imax denotes the maximum grayscale brightness value at the display brightness level corresponding to the gamma curve, and n denotes a gamma value. A standard gamma value currently defined is 2.2, and an allowable error range is usually plus or minus 0.2, so the standard gamma value range is 2.0 to 2.4. A gamma curve corresponding to the standard gamma value may be called a standard gamma curve. Since the standard gamma value range is 2.0 to 2.4, a gamma curve with a gamma value within the standard gamma value range should be between a gamma curve with a gamma value of 2.0 and a gamma curve with a gamma value of 2.4, that is, a gamma curve with a gamma value of 2.0 and a gamma curve with a gamma value of 2.4 are two critical gamma curves.

Figure 1:
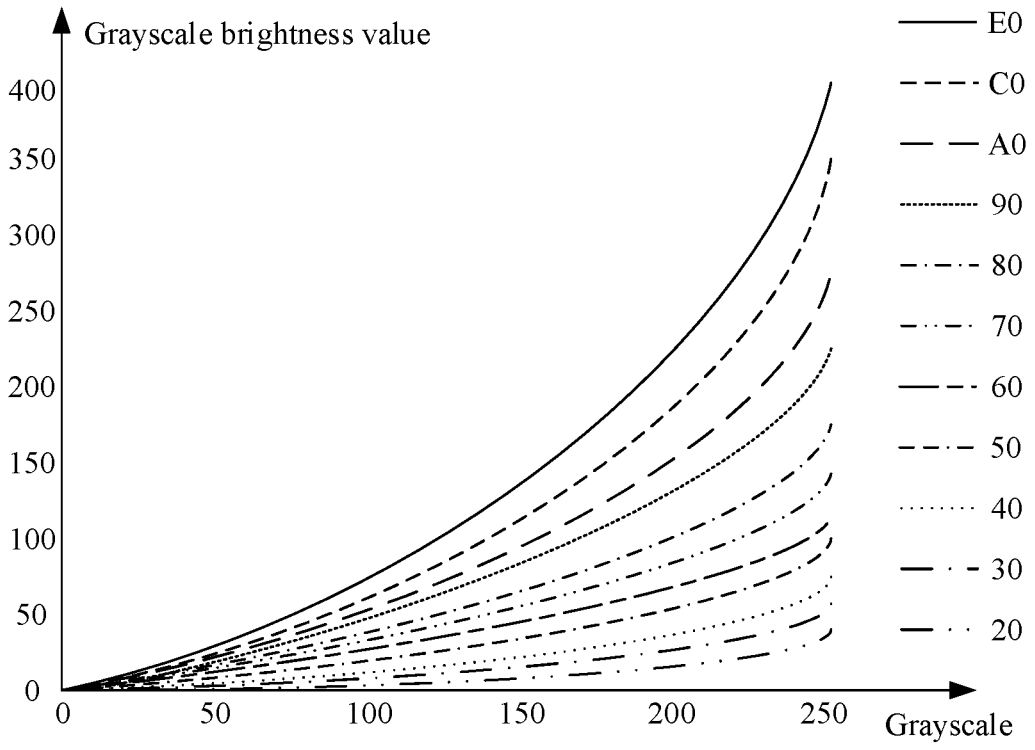
FIG. 1 is a diagram of standard gamma curves corresponding to different display brightness levels according to an embodiment of the present disclosure.

Exemplarily, FIG. 1 is a schematic diagram of standard gamma curves corresponding to different display brightness levels according to an embodiment of the present disclosure. As shown in FIG. 1, the abscissa represents the grayscale, and the ordinate represents the grayscale brightness value. In FIG. 1, the display brightness levels corresponding to 11 gamma curves are 20 nits, 30 nits, 40 nits, 50 nits, 60 nits, 70 nits, 80 nits, 90 nits, A0 nits, C0 nits and E0 nits respectively. Assuming that the display panel has these 11 display brightness levels, the minimum display brightness level of the display panel is 20 nits, and the maximum display brightness level of this display panel is E0 nits.

For an OLED display panel with a completed structure, deviations in the gamma values at the plurality of display brightness levels may occur. Since the problem of deviations of the gamma values of the OLED display panel under other display brightness levels cannot be solved after gamma correction is performed on the OLED display panel at certain display brightness level, it is necessary to perform gamma correction on the OLED display panel under multiple display brightness levels respectively. As each OLED display panel needs to be individually gamma corrected at the plurality of display brightness levels, a gamma correction process takes longer time, and thus the yield of the OLED display panels is affected.

Figure 2:
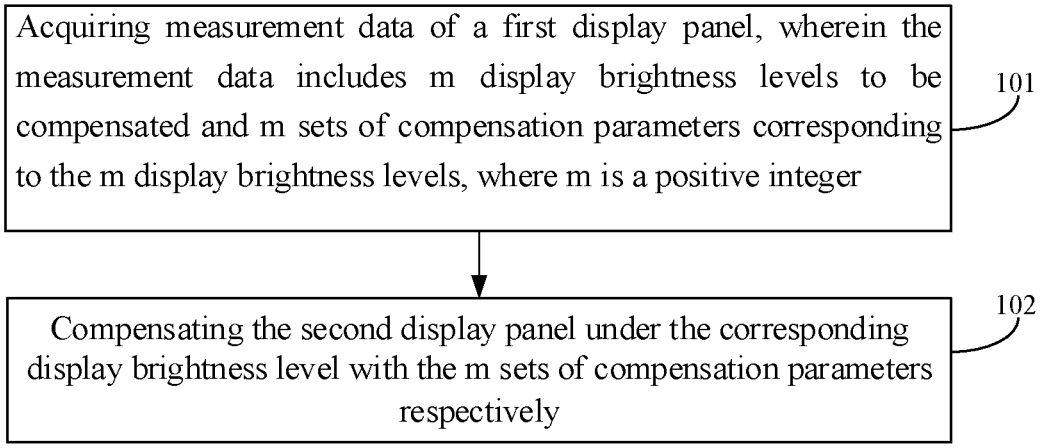
FIG. 2 is a flow chart of a gamma correcting method according to an embodiment of the present disclosure.

FIG. 2 is a flow chart of a gamma correction method according to an embodiment of the present disclosure. This gamma correcting method may be applied to an integrated circuit (IC) chip in a second display panel. As shown in FIG. 2, the method includes the following steps.

In step 101, measurement data of a first display panel is acquired, the measurement data includes m display brightness levels to be compensated and m sets of compensation parameters corresponding to the m display brightness levels, where m is a positive integer.

All display panels provided in the embodiment of the present disclosure are self-luminous display panels. For example, the first display panel may be an OLED display panel.

In step 102, the second display panel is compensated under the corresponding display brightness level with the m sets of compensation parameters respectively.

The second display panel and the first display panel have the same structure and material. The structure of the display panel includes a film layer structure of the display panel, and all physical structures such as the IC chip in the display panel. Optionally, the second display panel and the first display panel satisfy one of the following relationships: the second display panel and the first display panel are the same display panel; or, the second display panel and the first display panel are different display panels produced in the same production batch. The materials, structures, and IC chips of display panels in the same production batch are usually the same.

It should be noted that when the first display panel and the second display panel are different display panels, since the structures and materials of the second display panel and the first display panel are the same, before the panel is subjected to software debugging (such as gamma correction), the second display panel and the first display panel usually have the same gamma values at each display brightness level, and thus the measurement data of the first display panel can be applied to the second display panel.

In summary, in the gamma correction method provided by the embodiment of the present disclosure, the IC chip in the second display panel may use the acquired measurement data of the first display panel to compensate the second display panel without the need to perform multiple gamma corrections on the second display panel, which shortens the time spent in the gamma correction process, thereby further increasing the yield of the display panels.

Optionally, the m display brightness levels included in the measurement data acquired in the above step 101 may be display brightness levels that need to be compensated based on the first display panel determination, that is, each of the m display brightness levels needs to be compensated. Or the m display brightness levels included in the measurement data may be all display brightness levels of the first display panel, and then the compensation parameter corresponding to the display brightness level without the need of compensation in the m display brightness levels may be set to 0.

Optionally, the implementation process of step 101 above includes: determining m display brightness levels according to the brightness data of the first display panel on which the gamma correction at a second display brightness level is completed, the m display brightness levels are determined, wherein the second display brightness level is different from the m display brightness levels. The implementation process of step 102 above includes: after gamma correction is performed on the second display panel at the second display brightness level, using m sets of compensation parameters to compensate the second display panel under the corresponding second display brightness level.

It should be noted that, after the structure of the display panel is prepared, the gamma values under a plurality of display luminance may have large deviations. Gamma correction is performed on the display panel at certain display brightness level, so that the gamma value of the display panel at this display brightness level is within the standard gamma value range, gamma values of the display panel at other display brightness levels will also be close to the standard gamma values, that is, the deviations of the gamma value at the other display brightness levels will be reduced accordingly. Therefore, a display panel on which the gamma correction at a certain display brightness level is completed has less display brightness level that needs to be compensated than a display panel that on which the gamma correction is not completed. Furthermore, since the second display panel is compensated after gamma correction is performed on the second display panel at the second display brightness level, the time spent in the compensation process of the display panel may be shortened, thereby the compensation efficiency of the second display panel can be improved and the compensation effect on the second display panel can be guaranteed.

Optionally, the second display brightness level above is the maximum display brightness level of the first display panel and the second display panel. After the gamma correction at the maximum display brightness level is completed on the display panel, the deviation of gamma values at other display brightness levels will be reduced accordingly, which facilitates the compensation of the display panel at other display brightness levels through a compensating circuit. The second display brightness level may also be a display brightness level other than the maximum display brightness level, which is not limited in the embodiment of the present disclosure.

Optionally, the above brightness data is obtained by measuring the brightness of the first display panel at each display brightness level with an optical detector. After the gamma correction at the second display brightness level is completed on the first display panel, the brightness data may be obtained by measuring the brightness of the first display panel by the optical detector. The brightness data includes grayscale brightness values of all grayscale binding points on the gamma curve corresponding to each display brightness level. Simulation software may draw, based on this brightness data, gamma curves of the first display panel at each display brightness levels.

Figure 3:
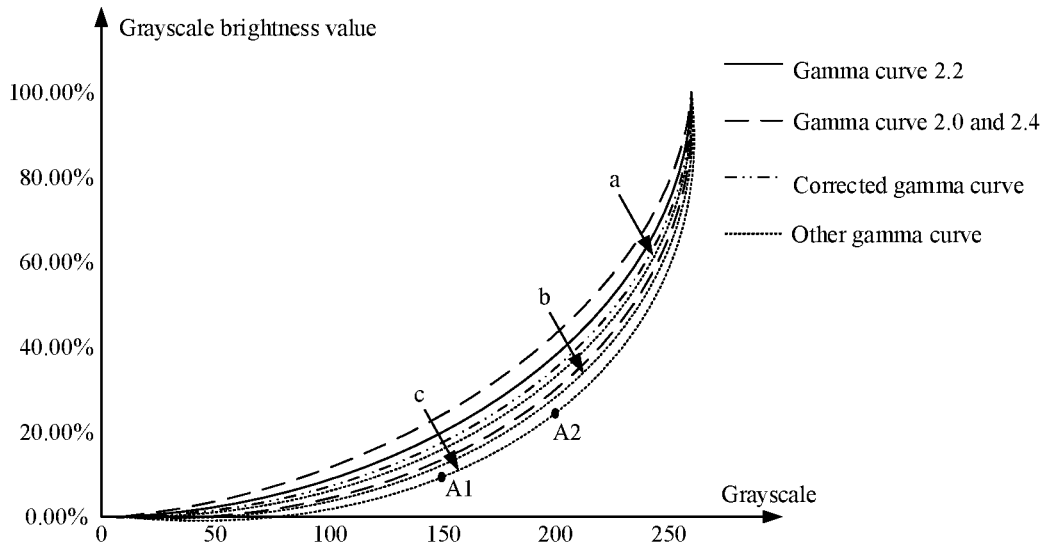
FIG. 3 is a schematic diagram of gamma curves of a first display panel at a plurality of display brightness levels according to an embodiment of the present disclosure.

Exemplarily, FIG. 3 is a schematic diagram of gamma curves of a first display panel at a plurality of display brightness levels according to an embodiment of the present disclosure. As shown in FIG. 3, the abscissa represents a pixel grayscale (referred to as grayscale for short), and the ordinate represents a normalized grayscale brightness value. The gamma curves in FIG. 3 include a standard gamma curve (gamma curve 2.2). Two critical gamma curves (gamma curve 2.0 and gamma curve 2.4), a gamma curve of the first display panel at the second display brightness level after the gamma correction at the second display brightness level (gamma curve after correction) is completed on the first display panel, and a plurality of other gamma curves generated according to brightness data which is obtained by measuring with an optical detector, the brightness of the first display panel on which the gamma correction at the second display brightness level (including a gamma curve a, a gamma curve b and a gamma curve c) is completed. With reference to FIG. 3, the gamma curve b and the gamma curve c are outside the two critical gamma curves, that is, the gamma values corresponding to both the gamma curve b and the gamma curve c are not within the standard gamma value range. Therefore, according to the brightness data of the first display panel on which the gamma correction at the second display brightness level is completed, the determined m display brightness levels include a display brightness level corresponding to the gamma curve b and a display brightness level corresponding to the gamma curve c.

Figure 4:
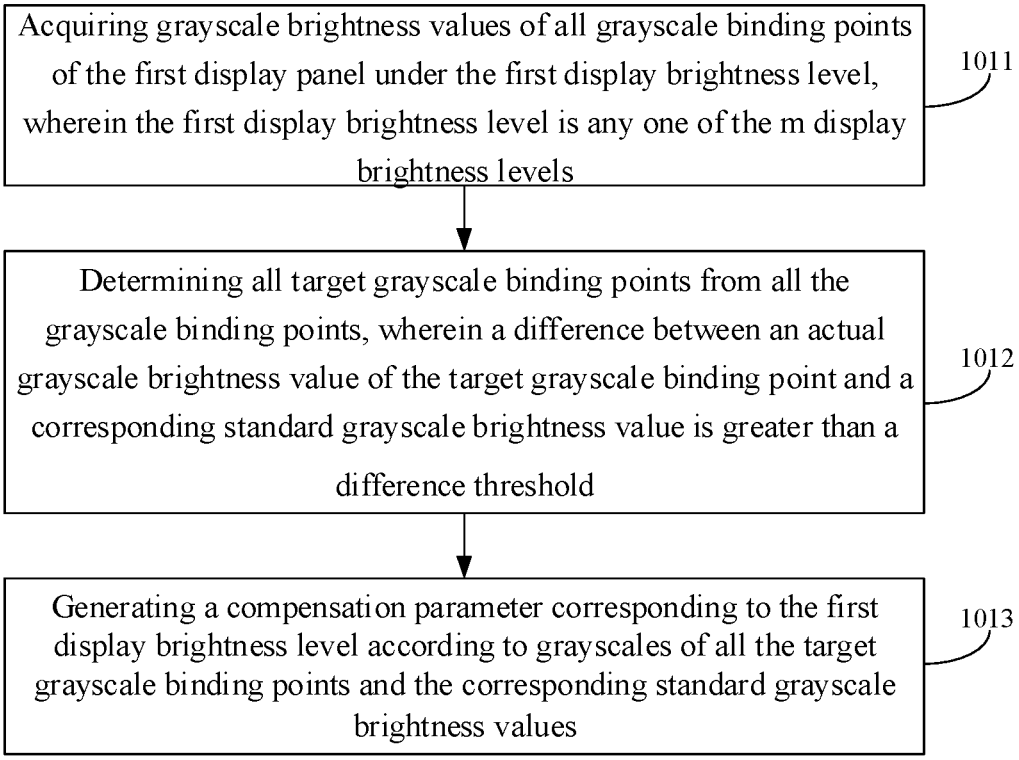
FIG. 4 is a flow chart of a method for acquiring measurement data of a first display panel according to an embodiment of the present disclosure.

Optionally, FIG. 4 is a flowchart of a method for acquiring measurement data of a first display panel according to an embodiment of the present disclosure. As shown in FIG. 4, the method includes the following steps.

In step 1011, grayscale brightness values of all grayscale binding points of the first display panel under the first display brightness level are acquired, wherein the first display brightness level is any one of the m display brightness levels.

Optionally, the number of the grayscale binding points under each display brightness level is determined according to a designed IC chip. Exemplarily, each display brightness level includes five grayscale binding points, and the grayscales of the 5 grayscale binding points are 50, 100, 150, 200 and 250 respectively. The grayscale binding point can reflect the correspondence between the grayscale and the grayscale brightness values. In the embodiment of the present disclosure, the grayscale binding point may be a point on the gamma curve. Exemplarily, with reference to FIG. 3, the gamma curve 3 has a grayscale binding point A1, and the abscissa of the grayscale binding point A1 is 150, the grayscale of A1 indicating the grayscale binding point is 150, and an ordinate represents a grayscale brightness value of the grayscale binding point A1.

In step 1012, all target grayscale binding points from all the grayscale binding points are determined, wherein a difference between an actual grayscale brightness value of the target grayscale binding point and a corresponding standard grayscale brightness value is greater than a difference threshold.

The standard grayscale brightness value refers to a grayscale brightness value of a grayscale binding point on the standard gamma curve. The standard grayscale brightness value corresponding to the first grayscale binding point refers to a grayscale brightness value of a grayscale binding point on the standard gamma curve that has the same grayscale of the first grayscale binding point, and the first grayscale binding point is any grayscale binding point at the first display brightness level. Different grayscale binding points have different difference thresholds. A difference threshold corresponding to the first grayscale binding point may be less than or equal to a difference between a critical grayscale brightness value and a corresponding standard grayscale brightness value, and the critical grayscale brightness value refers to a grayscale brightness value of a grayscale binding point on the critical gamma curve that has the same grayscale as the first grayscale binding point. Since the gamma curve is non-linear, the distance between the critical gamma curve and the standard gamma curve in the vertical axis direction changes with the change of the abscissa, the difference thresholds corresponding to different grayscale binding points are usually different. The difference threshold of each grayscale binding point may be designed according to the display accuracy required by the display panel, which is not limited in the embodiment of the present disclosure.

Optionally, when the difference threshold corresponding to the first grayscale binding point is equal to the difference between the critical grayscale brightness value and the corresponding standard grayscale brightness value, the target grayscale binding point refers to the grayscale binding point on the gamma curve at the first display brightness level that is located on the side of the critical gamma curve away from the standard gamma curve, wherein the actual grayscale brightness value of the target grayscale binding point and the corresponding standard grayscale brightness value is greater than the difference threshold, that is, the grayscale binding point not located between the two critical gamma curves. Exemplarily, with reference to FIG. 3, assuming that the gamma curve c is a gamma curve at the first display brightness level, and the grayscale binding points A1 and A2 on the gamma curve c are not between the two critical gamma curves, the grayscale binding points A1 and A2 can be used as the target grayscale binding points at the first display brightness level.

In step 1013, a compensation parameter corresponding to the first display brightness level is generated according to grayscales of all the target grayscale binding points and the corresponding standard grayscale brightness values.

Optionally, the implementation process of step 1013 includes: acquiring any two target grayscale binding points from all the target grayscale binding points; determining the compensation magnification and amount using the grayscales of the two any two grayscale binding points and the corresponding standard grayscale brightness values based on the correction formula, wherein the correction formula is Z=X*G+offset, where X denotes the compensation magnification, offset denotes the compensation amount, G denotes the grayscale of the target grayscale binding point, and Z denotes the corresponding standard grayscale brightness value of the target grayscale binding point; and when the difference between the target grayscale brightness value of each target grayscale constraint point that has been compensated with compensation magnification and compensation amount, and the corresponding standard grayscale brightness value is not greater than the difference threshold, the replacement magnification and the compensation amount are determined as a compensation parameter corresponding to the first display brightness level.

Optionally, the compensation parameter includes the compensation magnification and the compensation amount. Assuming that the standard grayscale brightness values corresponding to the two target grayscale binding points on the gamma curve at the first display brightness level are Z1 and Z2 respectively, and the grayscales of the two target grayscale binding points are G1 and G2 respectively, the compensation magnification X and the compensation amount offset corresponding to first display brightness level may be calculated based on the correction formula Z=X*G+offset. After calculating the compensation magnification X and the compensation amount offset, a compensation formula may be used to compensate the target grayscale binding points other than the two target grayscale binding points under the first display brightness. The compensation formula is Y=X*G+offset, where G represents a grayscale of some other target grayscale binding point, and Y represents a target grayscale brightness value of this other target grayscale binding point after been compensated. If the difference between the target grayscale brightness value of some other target grayscale binding point that has been compensated and the corresponding standard grayscale brightness value is still greater than the difference threshold, select two new target grayscale binding points to recalculate the compensation magnification and the compensation amount, until the difference between the target grayscale brightness value of each target grayscale binding point which has been compensated with the calculated compensation magnification and the compensation amount, and the corresponding standard grayscale brightness value is not greater than the difference threshold, that is, all the grayscale binding points on the gamma curve of the first display brightness level are located between the two critical gamma curves.

Optionally, the first display panel is a sample display panel. The measurement data of the first display panel may be determined based on measurement data of a plurality of sample display panels. For example, an average value of compensation parameters of the plurality of sample display panels at the same display brightness level may be taken as the compensation parameter of the first display panel at this display brightness level.

Optionally, after the compensation parameter corresponding to the first display brightness level is generated, the first display brightness level and the corresponding compensation parameter may be input into a register of an IC chip in the second display panel. The IC chip controls the compensating circuit through the register to compensate grayscale brightness values of pixels with the corresponding compensation parameter at the first display brightness level. When an 8-bit register is used, a maximum of 255 grayscales corresponding to grayscale luminance value may be compensated simultaneously. Compared with the time required for gamma correction in the related art, the time taken for the compensation process is extremely short. While ensuring the optical display effect of the display panel, the productivity of the display panel produced in batches can be improved Optionally, the measurement data obtained in step 101 above may further include grayscales of all target grayscale binding points at the first display brightness level. In this case, the implementation process of step 102 above includes: each target grayscale binding point of the second display panel at the first display brightness level is compensated with the compensation parameter corresponding to the first display brightness level.

Optionally, based on the grayscale of each target grayscale binding point, a compensation formula is used to compensate each target grayscale binding point of the second display panel at the first display brightness level. The compensation formula is Y=X*G+offset, where X represents the compensation magnification, offset represents the compensation amount, G represents the grayscale of the target grayscale binding point, and Y represents the target grayscale brightness value after compensation for the target grayscale binding point. The compensation magnification X and the compensation amount offset are calculated based on step 1013 above.

Optionally, the IC chip in the second display panel may control, according to a corresponding relationship between the display brightness level and the compensation parameter that is stored in the register, the compensating circuit to compensate the grayscale brightness values of pixels with the corresponding compensation parameter at the certain display brightness level.

It should be noted that the sequence of steps of the gamma correction method provided by the embodiments of the present disclosure may be adjusted properly, and the steps may also be correspondingly increased or decreased according to the circumstances. any person skilled in the art disclosed in this disclosure within the scope of the technology should be within the scope of protection of the present disclosure, and therefore will not be described herein.

In summary, in the gamma correction method provided by the embodiment of the present disclosure, the IC chip in the second display panel may use the acquired measurement data of the first display panel to compensate the second display panel without the need to perform multiple gamma corrections on the second display panel, which shortens the time consumed by the gamma correction process, thereby further increasing the yield of the display panels. In addition, the first display panel and the second display panel may belong to the same production batch, and the first display panel may be an extracted sampled display panel. Other display panels in this production batch are compensated based on the measurement data of the sample display panel. Thus, the yield of the batch-produced display panels may be increased while the optical display effect of the display panel is ensured.

Figure 5:
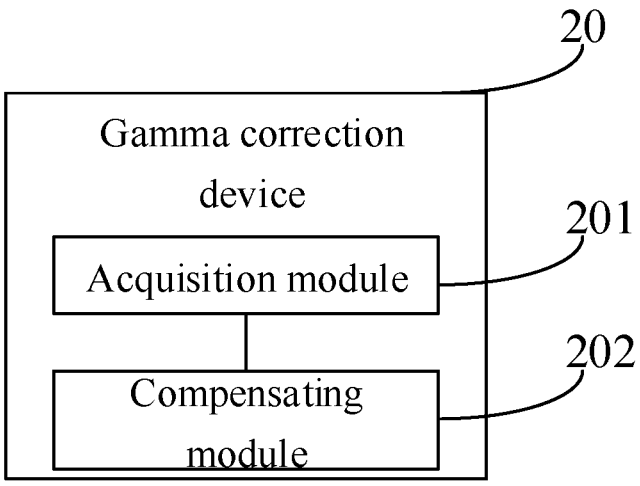
FIG. 5 is a schematic structural diagram of a gamma correction device according to an embodiment of the present disclosure.

FIG. 5 is a schematic structural diagram of a gamma correction device according to an embodiment of the present disclosure. As shown in FIG. 5, the device 20 includes:

an acquisition module 201, configured to acquire measurement data of the first display panel, wherein the measurement data includes m display brightness levels to be compensated and m sets of compensation parameters corresponding to the m display brightness levels, and m is a positive integer; and a compensating module 202, configured to compensate a second display panel at a corresponding display brightness level with the m sets of compensation parameters respectively, wherein the second display panel and the first display panel have the same structure and material.

In summary, in the gamma correction device according to the embodiment of the present disclosure, an IC chip in the second display panel may compensate, through the compensating module, the second display panel with the measurement data of the first display panel which is acquired through the acquisition module. There is no need to perform multiple gamma corrections on the second display panel, which shortens the time spent in the gamma correction process, thereby further increasing the yield of the display panels.

Figure 6:
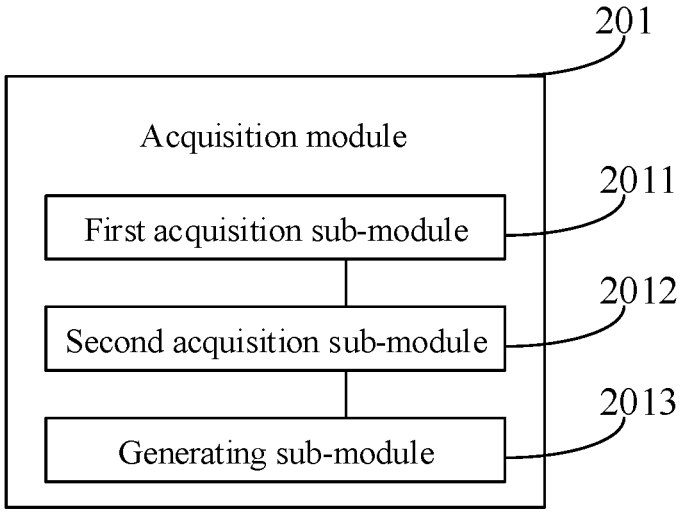
FIG. 6 is a schematic structural diagram of an acquisition module according to an embodiment of the present disclosure.

Optionally, as shown in FIG. 6, the acquisition module 201 includes: a first acquisition sub-module 2011, configured to acquire grayscale brightness values of all grayscale binding points of the first display panel at a first display brightness level, wherein the first display brightness level is any display brightness level among the m display brightness levels; a second acquisition sub-module 2012, configured to determine all target grayscale binding points from all the grayscale binding points, wherein a difference between an actual grayscale brightness value of the target grayscale binding point and a corresponding standard grayscale brightness value is greater than a difference threshold; and a generating sub-module 2013, configured to generate a compensation parameter corresponding to the first display brightness level according to grayscales of all the target grayscale binding points and the corresponding standard grayscale brightness values.

Optionally, the generating sub-module is configured to: acquire any two target grayscale binding points from all the target grayscale binding points; determine the compensation magnification and compensation amount using the grayscales of the any two target grayscale binding points and corresponding standard grayscale brightness values according to the correction formula, wherein the correction formula is Z=X*G+offset, where X denotes the compensation magnification, offset denotes the compensation amount, G denotes the grayscale of the target grayscale binding point, and Z denotes the corresponding standard grayscale brightness value of the target grayscale binding point; and when the difference between a target grayscale brightness value of each target grayscale binding point that has been compensated with the compensation magnification and the compensation amount and the corresponding standard grayscale brightness value is not greater than the difference threshold, determine the compensation magnification and the compensation amount as a compensation parameter corresponding to the first display brightness level.

Optionally, the measurement data further includes grayscales of all target grayscale binding points at the first display brightness level; and the compensating module is configured to: compensate each target grayscale binding points of the second display panel at the first display brightness level with the compensation parameter corresponding to the first display brightness level.

Optionally, the compensation parameter includes the compensation magnification and the compensation amount; and the compensating module is further configured to:

compensate, based on the grayscale of each of the target grayscale binding points, each target grayscale binding point of the second display panel at the first display brightness level with a compensation formula, wherein the compensation formula is Y=X*G+offset, where X represents the compensation magnification, offset represents the compensation amount, G represents the grayscale of the target grayscale binding point, and Y represents the target grayscale brightness value of the target grayscale binding point having been compensated.

Optionally, the acquisition module is configured to: determine the m display brightness levels according to the brightness data of the first display panel on which the gamma correction at a second display brightness level is completed, wherein the second display brightness level is different from the m display brightness levels; and the compensating module is configured to: after gamma correction is performed on the second display panel at the second display brightness level, compensate the second display panel at the corresponding display brightness level with the m sets of compensation parameters respectively.

Optionally, the second display brightness is the maximum display brightness.

Optionally, the brightness data is obtained by measuring the brightness of the first display panel at each display brightness level with an optical detector.

Optionally, the second display panel and the first display panel satisfy one of the following relationships: the second display panel and the first display panel belong to the same production batch; and the second display panel and the first display panel are the same display panel.

In summary, in the gamma correction device according to the embodiment of the present disclosure, the IC chip in the second display panel may compensate, through the compensating module, the second display panel with the measurement data of the first display panel which is acquired through the acquisition module, and thus there is no need to perform multiple gamma corrections on the second display panel, which shortens the time spent in the gamma correction process, thereby further increasing the yield of the display panels. In addition, the first display panel and the second display panel may belong to the same production batch, and the first display panel may be an extracted sampled display panel. Other display panels in this production batch are compensated based on the measurement data of the sample display panel. Thus, the yield of the batch-produced display panels may be increased while the optical display effect of the display panel is ensured.

With regard to the device in the foregoing embodiments, the specific manner in which the respective modules perform the operations has been described in detail in embodiments of the method, and will not be explained in detail herein.

An embodiment of the present disclosure provides a display device including a gamma correction device. The gamma correction device includes a processor and a memory, wherein the memory is configured to store a computer program; and the processor is configured to execute the computer program stored in the memory; the computer program includes instructions for implementing following operations: acquiring measurement data of a first display panel, wherein the measurement data comprises m display brightness levels to be compensated and m sets of compensation parameters corresponding to the m display brightness levels, where m is a positive integer; and compensating a second display panel at a corresponding display brightness level with the m sets of compensation parameters respectively; wherein the second display panel and the first display panel have the same structure and material.

Optionally, the display device may be an OLED display device.

The display device may be any product or component having a display function, such as electronic paper, a mobile phone, a tablet computer, a television, a display, a laptop computer, a digital photo frame and a navigator.

In summary, the display device according to the embodiment of the present disclosure includes the gamma correction device and the IC chip in the second display panel may compensate, through the compensating module, the second display panel with the measurement data of the first display panel which is acquired through the acquisition module, and thus there is no need to perform multiple gamma corrections on the second display panel, thereby shortening the time spent in the gamma correction process and further increasing the yield of the display panels.

An embodiment of the present disclosure provides a gamma correction device which may be integrated on an IC chip. The device includes: a processor and a memory, wherein the memory is configured to store a computer program; and the processor is configured to execute the computer program stored in the memory; the computer program includes instructions for implementing following operations: acquiring measurement data of a first display panel, wherein the measurement data comprises m display brightness levels to be compensated and m sets of compensation parameters corresponding to the m display brightness levels, where in is a positive integer; and compensating a second display panel at a corresponding display brightness level with the m sets of compensation parameters respectively; wherein the second display panel and the first display panel have the same structure and material.

Optionally, the computer program further comprises instructions for implementing following operations: acquiring grayscale brightness values of all grayscale binding points of the first display panel at a first display brightness level, wherein the first display brightness level is any display brightness level in the m display brightness levels; determining all target grayscale binding points from all the grayscale binding points, wherein a difference between an actual grayscale brightness value of the target grayscale binding point and a corresponding standard grayscale brightness value is greater than a difference threshold; and generating a compensation parameter corresponding to the first display brightness level according to grayscales of all the target grayscale binding points and the corresponding standard grayscale brightness values.

Optionally, the computer program further comprises instructions for implementing following operations: acquiring any two target grayscale binding points of all the target gray scale binding points; determining a compensation magnification and a compensation amount using the grayscales of the any two target grayscale binding points and the corresponding standard grayscale brightness values, according to a correction formula: Z=X*G+offset, where X denotes the compensation magnification, offset denotes the compensation amount, G denotes the grayscale of the target grayscale binding point, and Z denotes the standard grayscale brightness value corresponding to the target grayscale binding point; and determining the compensation magnification and the compensation amount as the compensation parameters corresponding to the first display brightness level when a difference between a target grayscale brightness value of each of the target gray scale binding points that have been compensated with the compensation magnification and the compensation amount and the corresponding standard grayscale brightness value is not greater than the difference threshold.

Optionally, the measurement data further comprises grayscales of all the target grayscale binding points at the first display brightness level, and the computer program further comprises instructions for implementing following operations: compensating each of the target grayscale binding points of the second display panel at the first display brightness level with the compensation parameter corresponding to the first display brightness level.

Optionally, the compensation parameter comprises a compensation magnification and a compensation amount, and the computer program further comprises instructions for implementing following operations: compensating, based on the grayscale of each of the target grayscale binding points, each of the target grayscale binding points of the second display panel at the first display brightness level according to a compensation formula; wherein the correction formula is Y=X*G+offset, where X denotes the compensation magnification, offset denotes the compensation amount, G denotes the grayscale of the target gray scale binding point, and Y denotes the grayscale brightness value of the target grayscale binding point after compensation.

Optionally, the computer program further comprises instructions for implementing following operations: determining the in display brightness levels according to brightness data of the first display panel on which gamma correction at a second display brightness level is completed, wherein the second display brightness level is different from the m display brightness levels; and compensating the second display panel at the corresponding display brightness level with the m sets of compensation parameters respectively after gamma correction is performed on the second display panel at the second display brightness level.

Optionally, the second display brightness level is a maximum display brightness level.

Optionally, the brightness data is obtained by measuring the brightness of the first display panel at each display brightness level with an optical detector.

Optionally, the second display panel and the first display panel satisfy one of the following relationships: the second display panel and the first display panel belong to the same production batch; and the second display panel and the first display panel are the same display panel.

Figure 7:
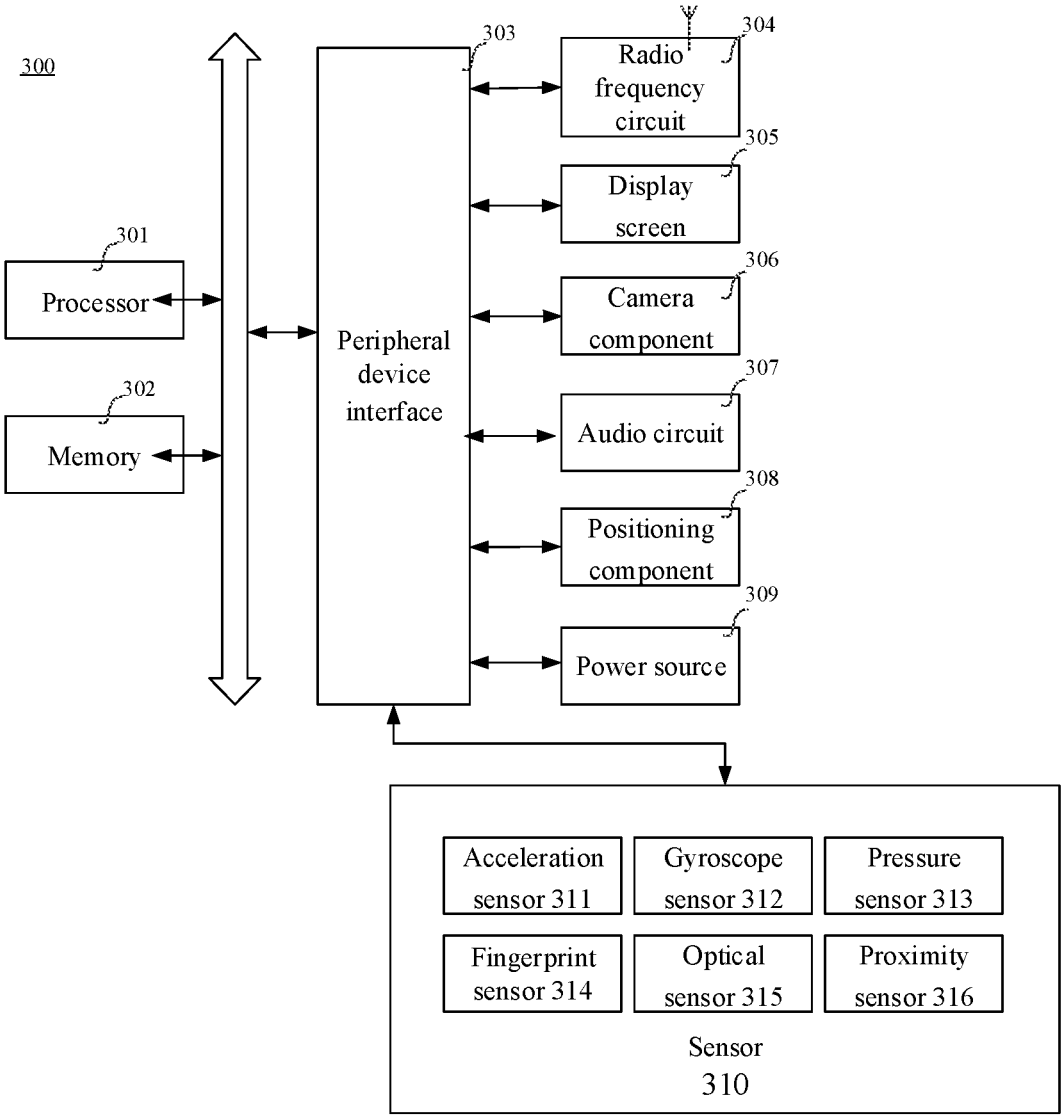
FIG. 7 is a block diagram of a gamma correction device according to an embodiment of the present disclosure.

FIG. 7 is a structural block diagram of a gamma correction device applicable in a display terminal. The display terminal 300 may be a portable mobile terminal such as a smart phone, a tablet computer, an MP3 (Moving Picture Experts Group Audio Layer III) player, an MP4 (Moving Picture Experts Group Audio Layer IV) player, a laptop or desk computer. The display terminal 300 may also be called a UE (User Equipment), a portable terminal, a laptop terminal, a desk terminal, etc.

Generally, the display terminal 300 includes a processor 301 and a memory 302.

The processor 301 may include one or more processing cores, such as a 4-core processor and an 8-core processor. The processor 301 may be implemented by using at least one of hardware forms of a DSP (Digital Signal Processing), an FPGA Programmable Gate Array), and a PLA (Programmable Logic Array). The processor 301 may also include a main processor and a co-processor. The main processor is a processor for processing data in an awake state, and is also referred to as a CPU (Central Processing Unit). The coprocessor is a low-power consumption processor for processing data in a standby state. In some embodiments, the processor 301 may be integrated with a GPU (Graphics Processing Unit), which is responsible for rendering and drawing of content that needs to be displayed on a display screen. In some embodiments, the processor 301 may further include an AI (Artificial Intelligence) processor, and the AI processor is configured to process computational operations related to machine learning.

The memory 302 can include one or more computer readable storage mediums, which can be non-transitory. The memory 302 may also include a high-speed random-access memory, and a non-volatile memory such as one or more magnetic disk storage devices and flash memory storage devices. In some embodiments, the non-transitory computer readable storage medium in the memory 302 is configured to store at least one instruction. The at least one instruction is configured to be executed by the processor 301 to implement the data query provided by the method embodiments of the present disclosure.

In some embodiments, the display terminal 300 optionally further includes a peripheral device interface 303 and at least one peripheral device. The processor 301, the memory 302, and the peripheral device interface 303 may be connected by a bus or a signal line. Each peripheral device can be connected to the peripheral device interface 303 by a bus, a signal line, or a circuit board. Specifically, the peripheral device includes at least one of a radio frequency circuit 304, a display screen 305, a camera 306 component, an audio circuit 307, a positioning component 308, and a power source 309.

The peripheral device interface 303 can be configured to connect at least one I/O (Input/Output)-associated peripheral device to the processor 301 and the memory 302. In some embodiments, the processor 301, the memory 302, and the peripheral interface 303 are integrated on the same chip or circuit board. In some other embodiments, any one or two of the processor 301, the memory 302, and the peripheral interface 303 can be implemented on a separate chip or circuit board, which is not limited in the present embodiment.

The radio frequency circuit 304 is configured to receive and transmit an RF (Radio Frequency) signal, also referred to as an electromagnetic signal. The radio frequency circuit 304 communicates with the communication network and other communication devices via the electromagnetic signal. The radio frequency circuit 304 converts the electrical signal into the electromagnetic signal for transmission, or converts the received electromagnetic signal into the electrical signal. Optionally, the radio frequency circuit 304 includes an antenna system, an RF transceiver, one or more amplifiers, a tuner, an oscillator, a digital signal processor, a codec chipset, a subscriber identity module card, and the like. The radio frequency circuit 304 can communicate with other terminals via at least one wireless communication protocol. The wireless communication protocol includes, but not limited to, a World Wide Web, a metropolitan area network, an intranet, various generations of mobile communication networks (2G, 3G, 4G, and 5G), a wireless local area network, and/or a WiFi (Wireless Fidelity) network. In some embodiments, the radio frequency circuit 304 may also include a circuit related to NFC (Near Field Communication), which is not limited in the present disclosure.

The display screen 305 is configured to display a UI (User Interface). The UI can include graphics, texts, icons, videos, and any combination thereof. When the display screen 305 is a touch display screen, the display screen 305 also has the capability of capturing a touch signal on the surface or over the surface of the display screen 305. The touch signal may be input to the processor 301 as a control signal for processing. At this point, the display screen 305 may also be configured to provide virtual buttons and/or a virtual keyboard, which are also referred to as soft buttons and/or soft keyboard. In some embodiments, one display screen 305 may be disposed, and disposed at the front panel of the display terminal 300. In other embodiments, at least two display screens 305 are disposed, and are respectively disposed on different surfaces of the display terminal 300 or in a folded design. In still other embodiments, the display screen 305 may be a flexible display screen disposed on a curved surface or folded surface of the display terminal 300. The display screen 305 may even be set to a non-rectangular irregular pattern, that is, a special-shaped screen. The display screen 305 may be an OLED (Organic Light-Emitting Diode) display panel.

The camera component 306 is configured to capture images or videos. Optionally, the camera component 306 includes a front camera and a rear camera. Typically, the front camera is placed on the front panel of the device and the rear camera is placed on the back of the display terminal. In some embodiments, at least two rear cameras are disposed, each of which is a main camera, a depth-of-field camera, a wide-angle camera, and a telephoto camera, so as to realize the background blur function by fusion of the main camera and the depth camera, the panoramic shooting and VR (Virtual Reality) shooting realized by fusion of the main camera and the wide-angle: camera, or other fused shooting functions. In some embodiments, the camera component 306 may also include a flash. The flash may be a monochrome temperature flash or a dual-color temperature flash. The dual-color temperature flash is a combination of a warm light flash and a cool light flash and can be used for light compensation at different color temperatures.

The audio circuit 307 may include a microphone and a loudspeaker. The microphone is configured to collect sound waves of the user and the environment, and convert the sound waves into electrical signals for being input to the processor 301 for processing, or being input to the radio frequency circuit 304 for voice communication. For the purpose of stereo acquisition or noise reduction, multiple microphones may be disposed, and are respectively disposed at different portions of the display terminal 300. The microphone may also be an array microphone or an omnidirectional acquisition microphone. The loudspeaker is then configured to convert the electrical signals from the processor 301 or the radio frequency circuit 304 into the sound waves. The loudspeaker may be a conventional film loudspeaker or a piezoelectric ceramic loudspeaker. When the loudspeaker is the piezoelectric ceramic loudspeaker, not only can the electrical signals be converted into the sound waves audible to humans, but also the electrical signals can be converted into the sound waves inaudible to humans for the purpose such as ranging. In some embodiments, the audio circuit 307 may also include a headphone jack.

The positioning component 308 is configured to position the current geographic location of the display terminal 300 to implement navigation or LBS (Location Based Service). The positioning component 308 may be a positioning component based on the US-based GPS (Global Positioning System), the Beidou system of China, or the European Galileo system.

The power source 309 is configured to supply power to various components in the display terminal 300, The power source 309 can be an alternating current, a direct current, a disposable battery, or a rechargeable battery. When the power source 309 includes the rechargeable battery, the rechargeable battery may be a wired rechargeable battery or wireless rechargeable battery. The wired rechargeable battery is a battery charged through a wired line, and the wireless rechargeable battery is a battery charged through a wireless coil. The rechargeable battery may also be configured to support the fast charging technology.

In some embodiments, the display terminal 300 also includes one or more sensors 310. The one or more sensors 310 include, but not limited to, an acceleration sensor 311, a gyroscope sensor 312, a pressure sensor 313, a fingerprint sensor 314, an optical sensor 315, and a proximity sensor 316.

The acceleration sensor 311 may detect the acceleration magnitudes on the three coordinate axes of a coordinate system established by the display terminal 300. For example, the acceleration sensor 311 can be configured to detect the components of gravity acceleration on the three coordinate axes. The processor 301 may control the touch display screen 305 to display a user interface in a landscape view or a portrait view according to the gravity acceleration signal collected by the acceleration sensor 311, The acceleration sensor 311 may also be used for collecting motion data of a game or user.

The gyro sensor 312 may detect the body direction and the rotation angle of the display terminal 300, and the gyro sensor 312 may cooperate with the acceleration sensor 311 to collect the 3D motion of the user on the display terminal 300 synergistically. According to the data collected by the gyro sensor 312, the processor 301 can implement the following functions of motion sensing (for example, changing the UI according to the tilting operation of a user), image stabilization during shooting, game control, and inertial navigation.

The pressure sensor 313 may be disposed on a side frame of the display terminal 300 and/or a lower layer of the touch display screen 305. When the pressure sensor 313 is disposed on the side frame of the display terminal 300, the holding signal of the user to the display terminal 300 can be detected, and the processor 301 can perform left-and-right hand recognition or quick operation according to the holding signal collected by the pressure sensor 313. When the pressure sensor 313 is disposed on the lower layer of the touch display screen 305, the processor 301 controls an operability control on the UI interface according to the pressure operation of the user on the touch display screen 305. The operability controls include at least one of a button control, a scroll bar control, an icon control, and a menu control.

The fingerprint sensor 314 is configured to collect the fingerprint of the user, and the processor 301 identifies the identity of the user according to the fingerprint collected by the fingerprint sensor 314, or the fingerprint sensor 314 identifies the identity of the user according to the collected fingerprint. When identifying that the identity of the user is a trusted identity, the processor 301 authorizes the user to perform related sensitive operations, including unlocking the screen, viewing encrypted information, downloading software, paying and changing settings, and the like. The fingerprint sensor 314 may be placed on the front, back or side surface of the display terminal 300. When the display terminal 300 is provided with a physical button or manufacturer logo, the fingerprint sensor 314 can be integrated with a physical button or vendor logo.

The optical sensor 315 is configured to collect ambient light intensity. In one embodiment, the processor 301 may control the display brightness of the touch display screen 305 based on the ambient light intensity collected by the optical sensor 315. Specifically, when the ambient light intensity is relatively high, the display brightness of the touch display screen 305 is increased. When the ambient light intensity is relatively low, the display brightness of the touch display screen 305 is reduced. In another embodiment, the processor 301 may also dynamically adjust the shooting parameters of the camera component 306 according to the ambient light intensity collected by the optical sensor 315.

The proximity sensor 316, also referred to as a distance sensor, is usually disposed on the front panel of the display terminal 300. The proximity sensor 316 is configured to capture the distance between the user and the front surface of the display terminal 300. In one embodiment, when the proximity sensor 316 detects that the distance between the user and the front surface of the display terminal 300 gradually decreases, the touch screen 305 is controlled by the processor 301 to switch from a bright screen state to a dark screen state. When the proximity sensor 316 detects that the distance between the user and the front surface of the display terminal 300 gradually increases, the processor 301 controls the touch display screen 305 to switch from the dark screen state to the bright screen state.

It will be understood by those skilled in the art that the structure shown in FIG. 7 does not constitute a limitation on the display terminal 300, and may include more or less components than those illustrated, or combine some components or adopt different component arrangements.

An embodiment of the present disclosure further provides a computer storage medium, which is non-transitory storage medium. The storage medium stores at least one instruction, at least one set of program, a code set or instruction set that, when executed by a processor, implements the gamma correction methods provided in the above-described embodiments.

An embodiment of the present disclosure further provides a computer program storing instructions. The instructions, when executed in a computer, cause the computer to implement the gamma correction methods provided in the above-described embodiments.

An embodiment of the present disclosure further provides a chip including Programmable Logic Device and/or program instructions. The chip, when running, is capable implementing the gamma correction methods provided in the above-described embodiments.

Persons of skill in the art can understand that the embodiments of the present disclosure can be implemented as methods, systems or computer program products. Therefore, the present disclosure may be completely implemented as hardware embodiments, software embodiments, or may be implemented as embodiments in combination with software and hardware. Additionally, the present disclosure may be implemented as a computer program product implemented on one or more computer available storage medium (includes but is not limited to a disk storage, a CD-ROM, an optical storage, etc.) including available program codes.

The present disclosure is described with reference to the flowcharts and/or block diagrams of the methods, devices (systems), and computer program products in the embodiments of the present disclosure. It should be understood that each process and/or block in the flowcharts and/or block diagrams, and combinations of processes and/or blocks in the flowcharts and/or block diagrams can be implemented by computer program instructions. These computer program instructions may be provided to a processor of a general-purpose computer, a special-purpose computer, an embedded processor, or other programmable data processing device to produce a machine, so that instructions executed by the processor of the computer or other programmable data processing device may be used to implement specified functions in one or more processes of the flowcharts and/or specified functions in one or more blocks of the block diagrams.

These computer program instructions may also be stored in a computer-readable memory capable of directing a computer or other programmable data processing device to work in a specific manner, such that the instructions stored in the computer-readable memory produce a product including an instruction device. The instruction device implements the specified functions in one or more processes of the flowcharts and/or specified functions in one or more blocks of the block diagrams.

These computer program instructions may also be loaded onto a computer or other programmable data processing device, such that a series of operation steps are performed on the computer or the programmable device to implement computer-implemented processes. Thus, the instructions executed on the computer or other programmable device implement the steps of the specified functions in one or more processes of the flowcharts and/or specified functions in one or more blocks of the block diagrams.

In a typical configuration, the computing device includes one or more processors (CPUs), input/output interfaces, network interfaces, and memories.

The memory may include a non-persistent memory, a random access memory (RAM), and/or a non-volatile memory in a computer-readable medium, such as a read-only memory (ROM) or a flash memory (flash RAM). Memory is an example of a computer-readable medium.

The computer-readable medium includes non-transitory and transitory medium and removable and non-removable media that can store information by any methods or technologies. Information may be computer-readable instructions, data structures, modules of a program, or other data. Examples of computer storage medium include, but are not limited to, a phase change memory (PRAM), a static random access memory (SRAM), a dynamic random access memory (DRAM), other types of random access memory (RAM), and a read-only memory (ROM), an electrically erasable programmable read-only memory (EEPROM), a flash memory or other memory technologies, read-only disc read-only memory (CD-ROM), digital versatile disc (DVD) or other optical storage, a magnetic tape cartridges, a disk memory or other magnetic storage devices or any other non-transmission media that may be configured to store information that can be accessed by computing devices. As defined herein, computer-readable media do not include transitory computer-readable media (transitory media), such as modulated data signals and carrier waves.

It should further be noted that the terms "including", "comprising" or any other variation thereof are intended to cover non-exclusive inclusion, so that a process, method, product or device including a series of elements not only includes those elements, but also includes other elements that are not explicitly listed, or elements that are inherent to such a process, method, product, or device. Without more restrictions, the element defined by the sentence "including a . . . " does not exclude that other identical elements are also stored in the process, method, product or device that includes the elements.

Those of ordinary skill in the art may understand that all or part of the steps described in the above embodiments can be completed through hardware, or through relevant hardware instructed by programs stored in a non-transitory computer readable storage medium, such as a read-only memory, a disk or a CD, etc.

The foregoing descriptions are merely optional embodiments of the present disclosure, and are not intended to limit the present disclosure. Within the spirit and principles of the disclosure, any modifications, equivalent substitutions, improvements, etc., are within the protection scope of the present disclosure.

What is claimed is:

1. A gamma correction method, comprising:

acquiring measurement data of a first display panel, wherein the measurement data comprises m display brightness levels to be compensated and m sets of compensation parameters corresponding to the m display brightness levels, where m is a positive integer; and compensating a second display panel at a corresponding display brightness level with the m sets of compensation parameters respectively, wherein the second display panel and the first display panel have same structure and material, wherein acquiring the measurement data of the first display panel comprises:

determining the m display brightness levels according to brightness data of the first display panel on which gamma correction at a second display brightness level is completed, wherein the second display brightness level is different from the m display brightness levels and is a maximum display brightness level, and wherein compensating the second display panel at the corresponding display brightness level with the m sets of compensation parameters respectively comprises:

compensating the second display panel at the corresponding display brightness level with the m sets of compensation parameters respectively after gamma correction is performed on the second display panel at the second display brightness level.

2. The method according to claim 1, wherein acquiring the measurement data of the first display panel comprises:

acquiring grayscale brightness values of all grayscale binding points of the first display panel at a first display brightness level, wherein the first display brightness level is any display brightness level in the m display brightness levels;

determining all target grayscale binding points from all the grayscale binding points, wherein a difference between an actual grayscale brightness value of the target grayscale binding point and a corresponding standard grayscale brightness value is greater than a difference threshold; and generating a compensation parameter corresponding to the first display brightness level according to grayscales of all the target grayscale binding points and the corresponding standard grayscale brightness values.

3. The method according to claim 2, wherein generating the compensation parameter corresponding to the first display brightness level according to the grayscales of all the target grayscale binding points and the corresponding standard grayscale brightness values comprises:

acquiring any two target grayscale binding points of all the target grayscale binding points;

determining a compensation magnification and a compensation amount using the grayscales of the any two target grayscale binding points and the corresponding standard grayscale brightness values, according to a correction formula: Z=X*G+offset, where X denotes the compensation magnification, offset denotes the compensation amount, G denotes the grayscale of the target grayscale binding point, and Z denotes the standard grayscale brightness value corresponding to the target grayscale binding point; and determining the compensation magnification and the compensation amount as the compensation parameters corresponding to the first display brightness level when a difference between a target grayscale brightness value of each of the target grayscale binding points that have been compensated with the compensation magnification and the compensation amount and the corresponding standard grayscale brightness value is not greater than the difference threshold.

4. The method according to claim 2, wherein the measurement data further comprises grayscales of all the target grayscale binding points at the first display brightness level, and compensating the second display panel at the corresponding display brightness level with the m sets of compensation parameters respectively comprises:

compensating each of the target grayscale binding points of the second display panel at the first display brightness level with the compensation parameter corresponding to the first display brightness level.

5. The method according to claim 4, wherein the compensation parameter comprises a compensation magnification and a compensation amount, and compensating each of the target grayscale binding points of the second display panel at the first display brightness level with the compensation parameter corresponding to the first display brightness level comprises:

compensating, based on the grayscale of each of the target grayscale binding points, each of the target grayscale binding points of the second display panel at the first display brightness level according to a compensation formula;

wherein the correction formula is Y=X*G+offset, where X denotes the compensation magnification, offset denotes the compensation amount, G denotes the grayscale of the target grayscale binding point, and Y denotes the grayscale brightness value of the target grayscale binding point after compensation.

6. The method according to claim 1, wherein the brightness data is obtained by measuring the brightness of the first display panel at each display brightness level with an optical detector.

7. The method according to claim 1, wherein the second display panel and the first display panel satisfy one of the following relationships:

the second display panel and the first display panel belong to the same production batch; and the second display panel and the first display panel are the same display panel.

8. A gamma correction device, comprising: a processor and a non-transitory memory, wherein the memory is configured to store a computer program; and the processor is configured to execute the computer program stored in the memory;

the computer program comprises instructions for implementing following operations:

acquiring measurement data of a first display panel, wherein the measurement data comprises m display brightness levels to be compensated and m sets of compensation parameters corresponding to the m display brightness levels, where m is a positive integer; and compensating a second display panel at a corresponding display brightness level with the m sets of compensation parameters respectively, wherein the second display panel and the first display panel have same structure and material, wherein acquiring the measurement data of the first display panel comprises:

determining the m display brightness levels according to brightness data of the first display panel on which gamma correction at a second display brightness level is completed, wherein the second display brightness level is different from the m display brightness levels and is a maximum display brightness level, and wherein compensating the second display panel at the corresponding display brightness level with the m sets of compensation parameters respectively comprises:

compensating the second display panel at the corresponding display brightness level with the m sets of compensation parameters respectively after gamma correction is performed on the second display panel at the second display brightness level.

9. The device according to claim 8, wherein the computer program further comprises instructions for implementing following operations:

acquiring grayscale brightness values of all grayscale binding points of the first display panel at a first display brightness level, wherein the first display brightness level is any display brightness level in the m display brightness levels;

determining all target grayscale binding points from all the grayscale binding points, wherein a difference between an actual grayscale brightness value of the target grayscale binding point and a corresponding standard grayscale brightness value is greater than a difference threshold; and generating a compensation parameter corresponding to the first display brightness level according to grayscales of all the target grayscale binding points and the corresponding standard grayscale brightness values.

10. The device according to claim 9, wherein the computer program further comprises instructions for implementing following operations:

acquiring any two target grayscale binding points of all the target grayscale binding points;

determining a compensation magnification and a compensation amount using the grayscales of the any two target grayscale binding points and the corresponding standard grayscale brightness values, according to a correction formula: Z=X*G+offset, where X denotes the compensation magnification, offset denotes the compensation amount, G denotes the grayscale of the target grayscale binding point, and Z denotes the standard grayscale brightness value corresponding to the target grayscale binding point; and determining the compensation magnification and the compensation amount as the compensation parameters corresponding to the first display brightness level when a difference between a target grayscale brightness value of each of the target grayscale binding points that have been compensated with the compensation magnification and the compensation amount and the corresponding standard grayscale brightness value is not greater than the difference threshold.

11. The device according to claim 9, wherein the measurement data further comprises grayscales of all the target grayscale binding points at the first display brightness level, and the computer program further comprises instructions for implementing following operations:

compensating each of the target grayscale binding points of the second display panel at the first display brightness level with the compensation parameter corresponding to the first display brightness level.

12. The device according to claim 11, wherein the compensation parameter comprises a compensation magnification and a compensation amount, and the computer program further comprises instructions for implementing following operations:

compensating, based on the grayscale of each of the target grayscale binding points, each of the target grayscale binding points of the second display panel at the first display brightness level according to a compensation formula;

wherein the correction formula is Y=X*G+offset, where X denotes the compensation magnification, offset denotes the compensation amount, G denotes the grayscale of the target grayscale binding point, and Y denotes the grayscale brightness value of the target grayscale binding point after compensation.

13. The device according to claim 8, wherein the brightness data is obtained by measuring the brightness of the first display panel at each display brightness level with an optical detector.

14. The device according to claim 8, wherein the second display panel and the first display panel satisfy one of the following relationships:

the second display panel and the first display panel belong to the same production batch; and the second display panel and the first display panel are the same display panel.

15. A display device, comprising the gamma correction device as defined in claim 8.

16. A non-transitory computer storage medium, comprising instructions stored therein, wherein the instructions, when executed by a processor, cause the process to implement a gamma correction method comprising:

acquiring measurement data of a first display panel, wherein the measurement data comprises m display brightness levels to be compensated and m sets of compensation parameters corresponding to the m display brightness levels, where m is a positive integer; and compensating a second display panel at a corresponding display brightness level with the m sets of compensation parameters respectively, wherein the second display panel and the first display panel have same structure and material, wherein acquiring the measurement data of the first display panel comprises:

determining the m display brightness levels according to brightness data of the first display panel on which gamma correction at a second display brightness level is completed, wherein the second display brightness level is different from the m display brightness levels and is a maximum display brightness level, and wherein compensating the second display panel at the corresponding display brightness level with the m sets of compensation parameters respectively comprises:

compensating the second display panel at the corresponding display brightness level with the m sets of compensation parameters respectively after gamma correction is performed on the second display panel at the second display brightness level.

17. The non-transitory computer storage medium according to claim 16, wherein acquiring the measurement data of the first display panel comprises:

acquiring grayscale brightness values of all grayscale binding points of the first display panel at a first display brightness level, wherein the first display brightness level is any display brightness level in the m display brightness levels;

determining all target grayscale binding points from all the grayscale binding points, wherein a difference between an actual grayscale brightness value of the target grayscale binding point and a corresponding standard grayscale brightness value is greater than a difference threshold; and generating a compensation parameter corresponding to the first display brightness level according to grayscales of all the target grayscale binding points and the corresponding standard grayscale brightness values.

18. The non-transitory computer storage medium according to claim 17, wherein generating the compensation parameter corresponding to the first display brightness level according to the grayscales of all the target grayscale binding points and the corresponding standard grayscale brightness values comprises:

acquiring any two target grayscale binding points of all the target grayscale binding points;

determining a compensation magnification and a compensation amount using the grayscales of the any two target grayscale binding points and the corresponding standard grayscale brightness values, according to a correction formula: Z=X*G+offset, where X denotes the compensation magnification, offset denotes the compensation amount, G denotes the grayscale of the target grayscale binding point, and Z denotes the standard grayscale brightness value corresponding to the target grayscale binding point; and determining the compensation magnification and the compensation amount as the compensation parameters corresponding to the first display brightness level when a difference between a target grayscale brightness value of each of the target grayscale binding points that have been compensated with the compensation magnification and the compensation amount and the corresponding standard grayscale brightness value is not greater than the difference threshold.

19. The non-transitory computer storage medium according to claim 17, wherein the measurement data further comprises grayscales of all the target grayscale binding points at the first display brightness level, and compensating the second display panel at the corresponding display brightness level with the m sets of compensation parameters respectively comprises:

compensating each of the target grayscale binding points of the second display panel at the first display brightness level with the compensation parameter corresponding to the first display brightness level.

20. The non-transitory computer storage medium according to claim 19, wherein the compensation parameter comprises a compensation magnification and a compensation amount, and compensating each of the target grayscale binding points of the second display panel at the first display brightness level with the compensation parameter corresponding to the first display brightness level comprises:

compensating, based on the grayscale of each of the target grayscale binding points, each of the target grayscale binding points of the second display panel at the first display brightness level according to a compensation formula;

wherein the correction formula is Y=X*G+offset, where X denotes the compensation magnification, offset denotes the compensation amount, G denotes the grayscale of the target grayscale binding point, and Y denotes the grayscale brightness value of the target grayscale binding point after compensation.

* * * * *